US006603863B1

(12) United States Patent
Nagayoshi

(10) Patent No.: US 6,603,863 B1
(45) Date of Patent: Aug. 5, 2003

(54) HEADPHONE APPARATUS FOR PROVIDING DYNAMIC SOUND WITH VIBRATIONS AND METHOD THEREFOR

(75) Inventor: Atsushi Nagayoshi, Taipei (CN)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/468,833

(22) Filed: Dec. 22, 1999

(30) Foreign Application Priority Data

Dec. 25, 1998 (JP) ..... 10-368898
May 25, 1999 (JP) ..... 11-144889

(51) Int. Cl.[7] ..... H04R 25/00

(52) U.S. Cl. ..... 381/380; 381/370; 381/378; 381/381

(58) Field of Search ..... 381/151, 182, 381/370, 378, 380, 326, FOR 130, 327, 330, 374, 381, 377, 379, 309, 17–19

(56) References Cited

U.S. PATENT DOCUMENTS 2,151,706 A * 3/1939 Lieber ..... 381/326
2,249,572 A * 7/1941 Lieber ..... 381/326
2,930,858 A * 3/1960 Hollingsworth ..... 381/381
3,134,861 A * 5/1964 Dempsey et al. ..... 381/151
3,586,425 A * 6/1971 Gilman ..... 16/228
3,600,068 A * 8/1971 Jolicoeur et al. ..... 16/228
3,604,861 A * 9/1971 Lewis ..... 381/381
3,980,842 A * 9/1976 Weisbrich ..... 379/447
4,006,318 A * 2/1977 Sebesta et al. ..... 381/151
4,110,583 A * 8/1978 Lepper ..... 381/382
4,173,715 A * 11/1979 Gosman ..... 381/382
4,309,575 A * 1/1982 Zweig et al. ..... 381/151
4,591,668 A * 5/1986 Iwata ..... 381/151
4,821,323 A * 4/1989 Papiernik ..... 381/182
4,901,355 A * 2/1990 Moore ..... 381/381
4,972,468 A * 11/1990 Murase et al. ..... 381/151
5,054,079 A * 10/1991 Frielingsdorf et al. ..... 381/151
5,164,987 A * 11/1992 Raven ..... 381/309
5,323,468 A * 6/1994 Bottesch ..... 381/151
5,335,285 A * 8/1994 Gluz ..... 381/327
5,438,626 A * 8/1995 Neuman et al. ..... 381/383
RE35,051 E * 10/1995 Moore ..... 381/381
5,457,751 A * 10/1995 Such ..... 381/375
5,506,911 A * 4/1996 Neuman et al. ..... 381/381
5,642,426 A * 6/1997 Neuman et al. ..... 381/312
5,715,323 A * 2/1998 Walker ..... 381/385
6,084,975 A * 7/2000 Perkins ..... 381/326
6,141,427 A * 10/2000 Fukuda ..... 381/151
6,233,345 B1 * 5/2001 Urwyler ..... 381/381
6,483,925 B1 * 11/2002 Shen et al. ..... 381/370

FOREIGN PATENT DOCUMENTS

EP 000334219 A * 9/1989
GB 000679303 A * 9/1952

* cited by examiner

*Primary Examiner*—Curtis Kuntz
*Assistant Examiner*—P. Dabney
(74) *Attorney, Agent, or Firm*—Wenderoth, Lind & Ponack, L.L.P.

(57) ABSTRACT

A headphone 10 has a pair of sound generating units 16 designed to be placed adjacent to ears of a user and a vibration generating unit 14 designed to be placed on a back neck of the user. In response to an audio signal, the sound generating units 16 generate acoustic sound and then provide it to the ears. Simultaneously with this, in response to the audio signal, the vibration generating unit generates vibrations to be provided to the back neck of the user. Then, the user will perceive the acoustic sound through ears and the vibrations through the back neck simultaneously. This provides the user with a dynamic sound effect.

16 Claims, 11 Drawing Sheets

HEADPHONE APPARATUS FOR PROVIDING DYNAMIC SOUND WITH VIBRATIONS AND METHOD THEREFOR

FIELD OF THE INVENTION

The present invention relates to a headphone apparatus for use with a stereo audio system. In particular, the present invention relates to a headphone apparatus for preferably use with a portable stereo audio device. Also, the present invention relates to a method for providing sophisticated and dynamic sound through a headphone device.

BACKGROUND OF THE INVENTION

U.S. Pat. No. 5,867,582 as well as its original Japanese Patent Application No. 7/288887, both assigned to the applicant, discloses a headphone device having an elongated headband in the form of approximately semicircular configuration. As is known in the art, the headband is provided at its opposite ends with acoustic transducers, respectively. In addition to this, vibrators are provided adjacent to the transducers at opposite ends of the headband, respectively.

With the headphone device, an audio signal is transmitted to the left and right acoustic transducers. The transducers generate stereo acoustic sound in response to the audio signal. On the other hand, a limited band of frequency, i.e., lower frequencies, of the audio signal is transmitted to the vibrators. In response to the lower frequencies, the vibrators generate vibrations. The generated acoustic sound and vibrations are simultaneously provided to the user who wears the headphone device 10. This allows the user to receive a dynamic stereo sound with vibrations.

However, the headphone device includes left and right vibrators, which disadvantageously causes the headphone device to be heavier.

Also, as is known in the art, in order to support the headphone device in a stable state on the user's head, the headband is configured in the form of reversed "U" so that it can be extended from one ear to another over the head. However, the headband may prevent the user from his or her operation for taking on and off his or her hat. For example, if the user wears the headphone over the hat, in order to take off his or her hat the user must take off the headphone before taking off his or her hat. Contrary to this, if the user wears the headphone under the hat, in order to take off the headphone the user must take off his or her hat before taking off the headphone.

SUMMARY OF THE INVENTION

Therefore, an object of the present invention is to provide a headphone apparatus capable of providing dynamic stereo sound concurrent with vibrations.

Another object of the present invention is to provide a headphone apparatus which allows the user to take on and off the headphone without any need for taking off the hat and which allows the user to take on and off the hat without any need for taking off the headphone.

Another object of the present invention is to provide a stylish, well-fashioned headphone apparatus.

Another object of the present invention is to provide a method for providing a stereo sound with vibrations, for preferably use in the headphone apparatus.

For those purposes, a headphone apparatus according to the present invention comprises a pair of sound generating units each having acoustic transducers. The sound generating units are designed to be placed adjacent to left and right ears of a user, respectively. The headphone apparatus also has a vibration generating unit having a vibrator. The vibration generating unit are designed to be placed on a back of user's neck. In operation, in response to an audio signal, the electric transducers generate acoustic sound and the vibrator generates vibrations simultaneously. The acoustic sound is perceived by the left and right ears of the user. On the other hand, the vibrations are perceived at the back neck of the user. This allows the user to perceive the acoustic sound simultaneously with the vibrations, which provides the user with a sophisticated and dynamic combination of the sound and vibrations.

In another aspect of the headphone apparatus of the present invention, the headphone apparatus further comprises a U-shaped band having opposed opposite ends. Also, the band supports the sound generating units at the opposite ends, respectively, and the vibration generating unit at its intermediate portion. This allows the user to perceive the vibrations at three portions; back neck and left and right ears. This means that the user can perceive a dynamic sound effect.

In another aspect of the headphone apparatus of the present invention, each of the sound generating units includes an arm, the arm being connected at its one end with one of the opposite ends and extended radially outwardly from an axis extending across the opposed opposite ends of the band. Also, the electric transducer is provided at the other end of the arm. This allows the generated vibrations are transmitted through the band and arms to the user's ears.

In another aspect of the headphone apparatus of the present invention, the arms are rotatably connected with the opposed opposite ends about the axis. This allows the headphone apparatus to adjust a distance between the sound and vibration generating units according to the corresponding size, i.e., the distance from the ear to the back neck, of the user.

In another aspect of the headphone apparatus of the present invention, each of the arms has a spring which biases the arm about the axis toward the band so that the vibration generating unit is forced onto the neck back of the user. This allows the vibration generating unit to be positively placed on the back neck of the user, causing the user to perceive dynamic stereo sound with vibrations.

In another aspect of the headphone apparatus of the present invention, the arm includes a housing for receiving the acoustic transducer. Also, the housing is sized and shaped so that it can be placed on an auricle of said user. This permits the headphone apparatus to be small sized, lightweighted, and easy to carry.

In another aspect of the headphone apparatus of the present invention, the vibrator is fixed in the band. With this arrangement, the vibrations are transmitted through the band to the user's back neck and ears.

In another aspect of the headphone apparatus of the present invention, the band has left and right elastic portions, each of the elastic portions being extended from the vibration generating unit and the pair of sound generating units. With this arrangement, the generated vibrations is increased and thereby transmitted the entire length of the band, which causes the user to perceive more dynamic sound with vibrations.

In another aspect of the headphone apparatus of the present invention, the vibration generating unit receives a specific band of frequency in the audio signal and generates vibrations in response to the specific band of frequency. With this arrangement, the vibrations are generated from the specific band of frequency.

In another aspect of the headphone apparatus of the present invention, the specific band of frequency includes a lower frequency component in the audio signal. With this arrangement, in particular at listening music, the user can perceive the sound and vibrations of low frequencies at the same time. Namely, the user can perceive a realistic performance in which the lower frequencies are strengthened.

In another aspect of the headphone apparatus of the present invention, the headphone apparatus comprises a controller which controls the specific frequencies to be received by the vibration generating unit. This allows the user to control the level of the vibrations depending upon his or her preference.

In another aspect of the headphone apparatus of the present invention, the controller is provided in the band. With this arrangement, the user can control the level of the vibrations while listening.

Also, a method for providing acoustic sound and vibrations simultaneously, comprising the steps of:

providing an audio signal;

driving a pair of acoustic transducers in response to the audio signal to generate corresponding acoustic sound, the pair of the acoustic transducers being placed adjacent to respective ears of a user;

driving a vibrator in response to the audio signal to generate corresponding vibrations, the vibrator being placed on a back neck of the user.

In another method for providing acoustic sound and vibrations simultaneously, comprising the steps of:

providing an audio signal;

providing acoustic sound in response to the audio signal to left and right ears of a user; and providing vibrations to a back neck of the user in response to a lower frequency component of the audio signal.

As can be seen from above, the headphone apparatus and the method therefor can provide acoustic sound and vibrations at the same time. Also, the headphone apparatus and the method therefor allow its user to take on and off the headphone apparatus irrelevant to whether he or she is wearing a soft or hard hat, and to take on and off the soft or hard hat irrelevant to whether he or she is wearing the headphone apparatus.

BRIEF DESCRIPTION OF THE DRAWINGS

FIG. 10A is a plan view of a yoke, FIG. 10B is a partial cutout side elevational view of the vibration member, and FIG. 10C is a plan view of a vibration plate;

DETAILED DESCRIPTION OF THE PREFERRED EMBODIMENTS

Figure 1:
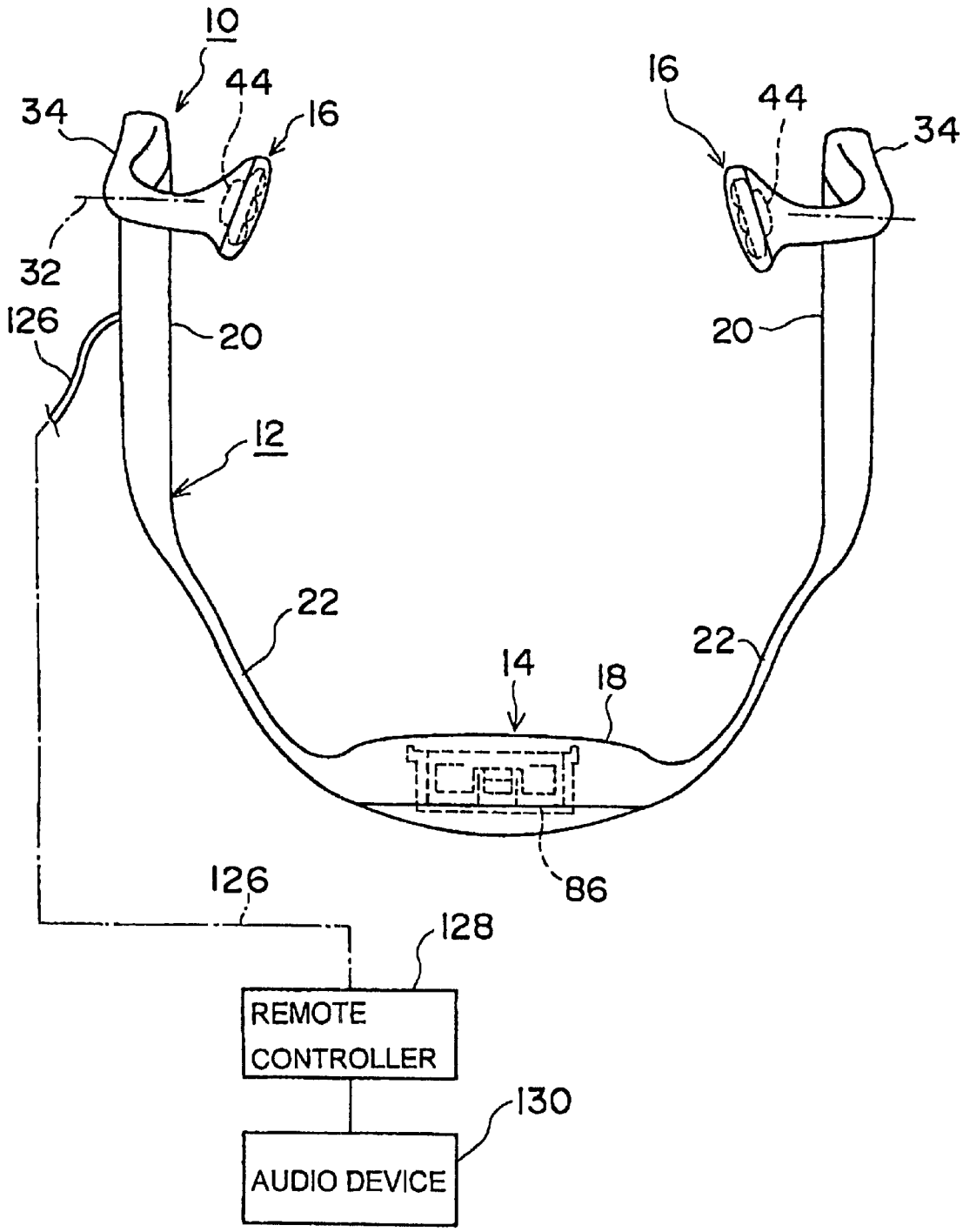
FIG. 1 is a plan view of a headphone apparatus according to the preferred embodiment of the present invention.

Referring to FIGS. 1 to 5, there is shown a headphone device according to the embodiment of the present invention, generally indicated by reference numeral 10. The headphone device 10 has an approximately U-shaped band, generally indicated by reference numeral 12. Preferably, the band 12 is made of flexible material. The material may be synthetic resin such as polypropylene or metal such as aluminium, stainless, titanate, and combination thereof. For reducing a weight of the headphone device 10, the band 12 should be made of synthetic resin rather than metal. For further lightening, the band 12 according to the embodiment is molded out of polypropylene. However, the band may be assembled with various parts made of resin, metal, or combination thereof.

Figure 2:
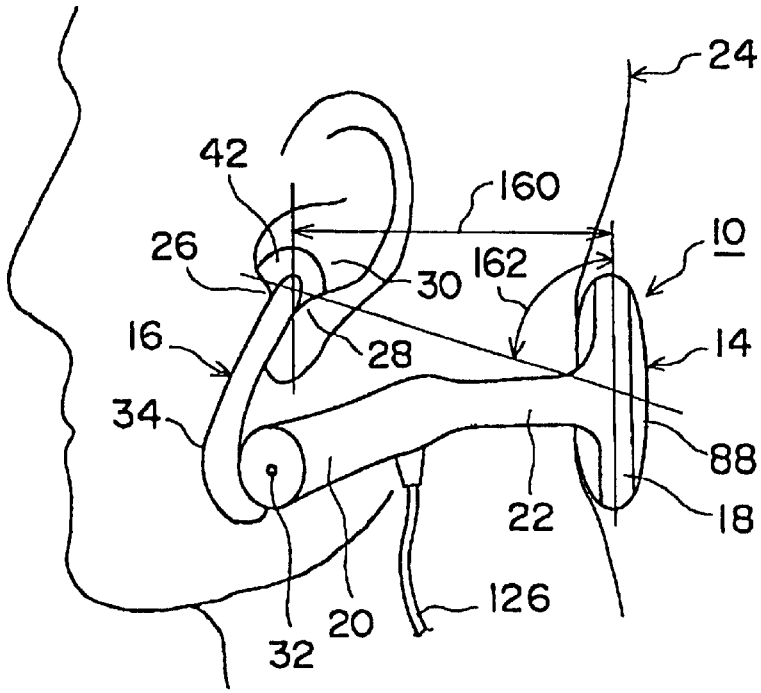
FIG. 2 is a perspective view of a user wearing the headphone apparatus shown in FIG. 1.

As best shown in FIG. 1, the band 12 is provided at its intermediate portion with a vibration generating unit generally indicated by reference numeral 14, and also at its opposite ends with sound generating units each generally indicated by reference numerals 16. Preferably, a central portion 18 of the band 12, which is a part of the vibration output 14, and opposite end portions 20 of the band 12, adjacent to the sound generating unit 16, have a greater thickness or rigidity so that they would resist a certain external force. On the other hand, connecting portions 22 extending between the central portion 18 and the opposite end portions 22 may be thinned so that they have a certain elasticity. This results in that, when the headphone device 10 is worn by the user, the sound generating units 16 can fit on the aimed portions of the ears with a suitable pressure, allowing the headphone device 10 to be supported positively on the user. As shown in FIG. 2, the sound generating unit 16, which is designed in the form of earphone in this embodiment, is suitably fitted on the auricle 30 between the tragus 26 and antitragus 28.

Figure 6:
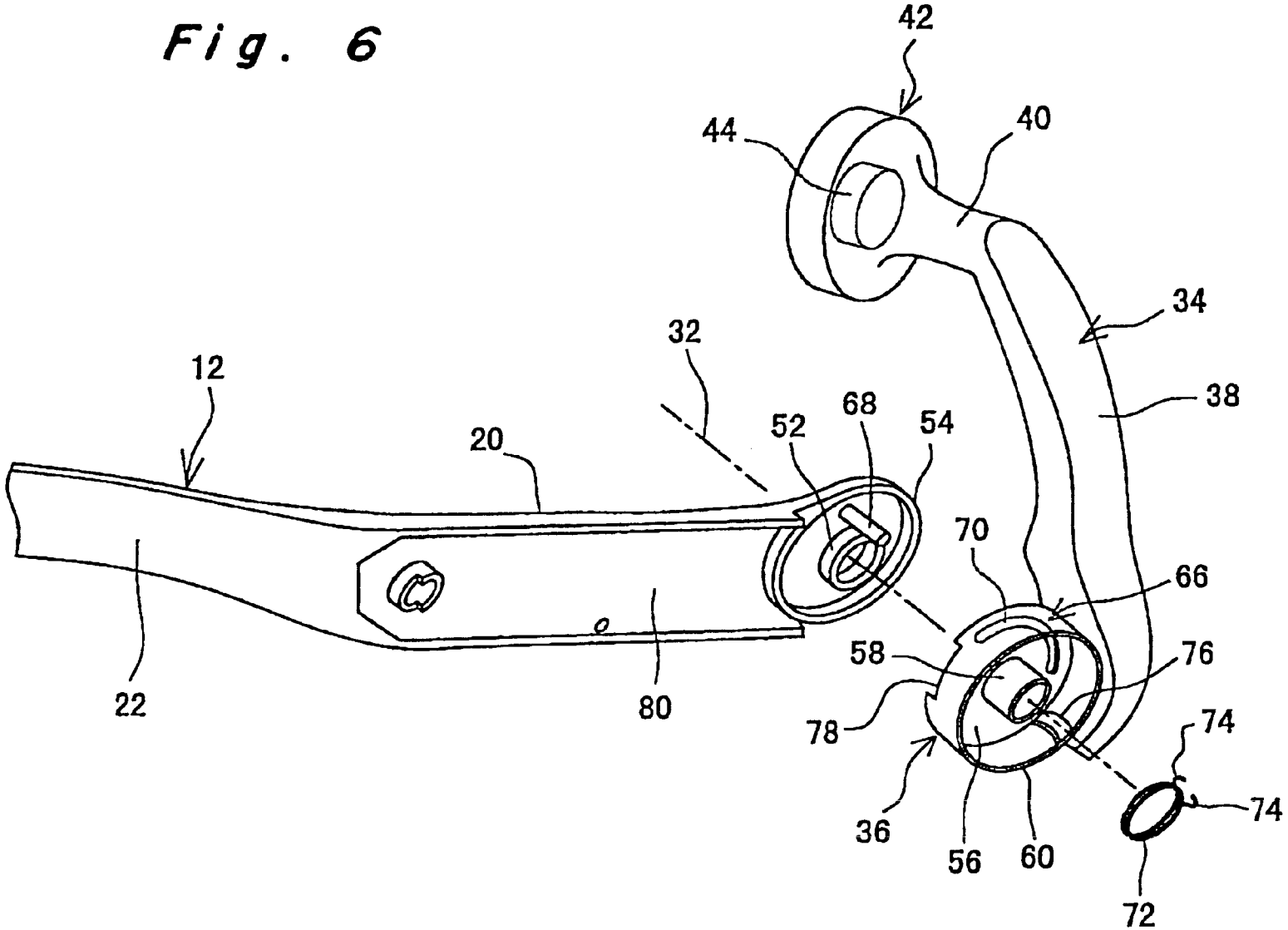
FIG. 6 is a partial perspective view of the exploded headphone apparatus shown in FIG. 1.

Each of the sound generating units 16 has an arm 34 extending radially and outwardly from an axis 32 (shown in the phantom line in FIG. 1) connecting left and right end portions of the band 12. As best shown in FIG. 6, the arm 34 has four portions; connecting portion 36, extended portion 38, supporting portion 40, and earphone housing 42. The connecting portion 36 is connected to the end portion of the band 12 as it can rotate about the axis 32. The extended portion 38 is connected at its one end with the connecting portion 36 and extended outwardly and radially from the axis 32. The supporting portion 40 is extended inwardly from the opposite end of the extended portion 38 toward the opposite arm 34. The earphone housing 42 is shaped and sized so that it can be fitted on the auricle 30 between the tragus 26 and antitragus 28 and is mounted at the tip of the supporting portion 40. In this embodiment, the arm 34 is made of several parts, but it may be molded as a single part.

Figure 5:
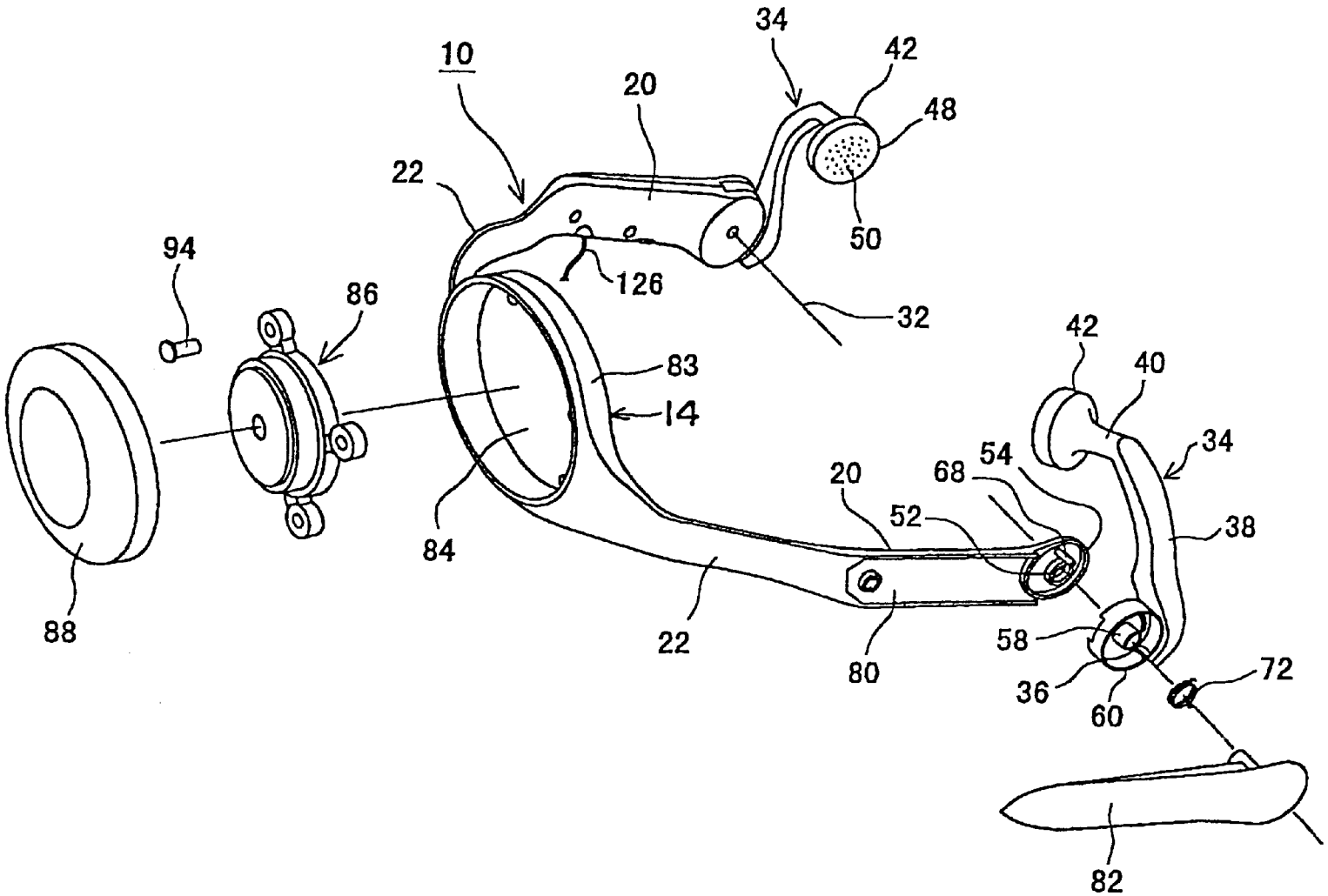
FIG. 5 is a perspective view of the exploded headphone apparatus shown in FIG. 1.

The earphone housing 42 accommodates an acoustic transducer 44. Any type of conventional acoustic transducer may be used as long as it can transduce electric signal into corresponding sound. The transducer 44 is electrically connected with a headphone circuit 120 through wires 136 and 138 (see FIG. 11). To reveal and protect the wires, the arm 34 includes a passage 46 (see FIG. 7) for receiving wires 136 and 138 (also see FIG. 11). Also, as shown in FIGS. 5 and 8, the earphone housing 42 includes a plurality of small apertures 50 in its front wall portion 48 which would face to the external auditory meatus of the user 24 when it is fitted to the ear. In this case, the reproduced sound is fed out of the apertures 50. Alternatively, the wall portion 48 may be made of suitable metal mesh.

Referring again to FIG. 6, the arm 34 is connected at its connecting portion 36 with the band 12 so that it can rotate about the axis 32. For this purpose, the end portion of the band 12 for bearing the arm 34 is integrally formed with inner and outer cylindrical rec0eiving portions 52 and 54 in a concentric configuration about the axis 32. The connecting portion 36 of the arm 34, on the other hand, is integrally formed with a doughnut-like disk plate 56, and concentric inner and outer cylindrical portions 58 and 60. The cylindrical portions 58 and 60 are projected a certain distance from inner and outer peripheries of the disk 56 in the opposite directions and parallel to the axis 32. It should be noted that the outer diameter of the inner cylindrical portion 58 is slightly smaller than the inner diameter of the outer cylindrical receiving portion, and the outer diameter of the outer cylindrical portion 60 is substantially equal to the outer diameter of the outer cylindrical receiving portion 54. Therefore, when assembling, the inner cylindrical portion 58 of the arm 34 can be inserted in the inner cylindrical receiving portion 52 of the band 12 with the end surface of the outer cylindrical portion 60 faced to the opposing end surface of the outer cylindrical receiving portion 54. This allows the arm 34 to rotate about the axis 32, relative to the band 12.

Referring again to FIG. 3, a restriction mechanism generally indicated by reference numeral 66 is provided in order to limit a moving range or angle of the arm 34 in between a first position 62 where the arm 34 lies against the band 12 and a second position 64 where the arm 34 is angled away from the band 12. As best shown in FIG. 6, the restriction mechanism 16 includes a pin 68 integrally formed on and projected from an intermediate portion of the disk 56 between inner and outer cylindrical receiving portions 52 and 54, toward the connecting portion 36 and parallel to the axis 32. The disk 56 of the connecting portion 36 is defined with an elongated aperture or slot 70 extending peripherally about the axis 32 between the inner and outer cylindrical portions 58 and 60. When assembling the arm 34 with the band 12, the pin 68 is positioned in the slot 36. The opposite ends of the slot 36 correspond to the above-described first and second positions 62 and 64. This means that the arm 34 rotates relative to the band 12 within which the pin 68 can move along the slot 70, i.e., between the first and second positions 62 and 64.

The arm 34 is forced from the second position 64 toward the first position 62 when it is assembled with the band 12. For this purpose, as shown in FIG. 6, a helical spring 72 is mounted around the inner cylindrical portion 58 adjacent to the outside surface of the disk 56. The helical spring 72 is formed at its opposite ends with an curved portions or hooks 74. One hook 74 is engaged with the tip portion of the pin 68 projected from the slot 70, and the other hook 74 is engaged with a portion 76 projected from the inner surface of the outer cylindrical portion 60, causing the arm 34 to be forced from the second position 64 toward the first position 62.

Referring again to FIG. 6, the outer cylindrical portion 60 of the connecting portion 36 is formed with a cutout 78 in its end portion facing to the cylindrical receiving portion 54. The cutout 78 is used for guiding the wires 136 and 138 (see FIG. 11), connected with the transducer 44 and extended out of the proximal end of the extended portion 38, into a chamber 80 defined on the outside of the end portion of the band 12. As can be seen from the drawing, the cutout 78 is extended to a certain extent along the periphery of the outer cylindrical portion 60 so that, when the arm 34 rotates relative to the band 12 between the first and second positions 62 and 64, no damaging tension or shearing stress would act on the wire 136 or 138. For safe, the chamber 80 is of course closed with a suitable cover 82 (see FIG. 5).

Referring to FIG. 5, the vibration output 14 has an ellipsoidal portion 83 which is integrated in the central portion of the band 12 by extending the central portion widthwise. The ellipsoidal portion 83 is recessed inwardly to define a cavity 84 in which the vibrator 86 is fixedly received. The cavity 84 is closed at its opening so that the vibrator 86 is not viewable.

Figure 9:
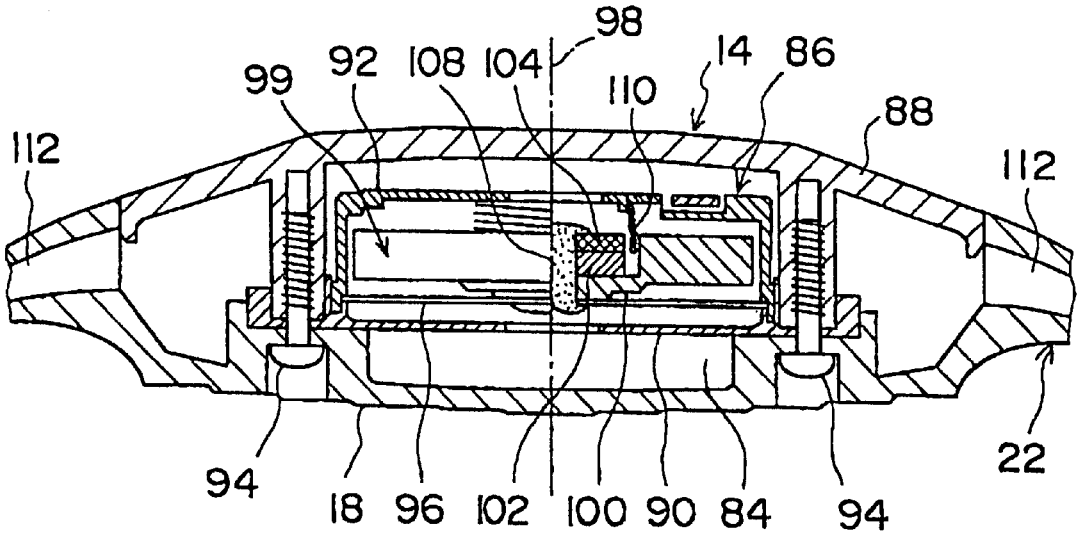
FIG. 9 is a cross-sectional view of a vibration generating unit of the headphone apparatus shown in FIG. 1.

As best shown in FIG. 9, the vibrator 86 includes a base plate 90 and cylindrical cover 92 so that they define a chamber having a certain volume. Also, the vibrator 86 is secured in the cavity 84 using a plurality of suitable screws 94. In the chamber between the base plate 90 and cylindrical cover 92, a thinned circular plate 96 made of metal is supported. In this embodiment, the plate 96 is held at its peripheral portions by the base plate 90 and the cylindrical cover 92. Also, as best shown in FIG. 10C, the plate 96 has several elongated cutouts so that it has a suitable elasticity.

Also, a yoke 100 is coaxially provided on the elastic plate 96. The yoke 100 has a cylindrical recess at its center in which cylindrical permanent magnet 102 and metal plate 104 are received. Preferably, the yoke 100, permanent magnet 102, and metal 104 are arranged in concentric fashion about a central axis 98 of the elastic plate 96 and secured on the elastic plate 96 by a fixing member 108 extending along the axis 98, thereby constituting a vibration assembly 99.

Further, a helical coil 110 is provided in the chamber. The coil 110 is fixed at its one end on the inner surface of the top wall of the cover 92 and extended into a cylindrical space defined between the permanent magnet 104 and a portion of the yoke 100 spaced away from the magnet. Therefore, when the helical coil 110 is biased with an electrical signal or variable voltage which varies with time, e.g., audio signal, it generates a magnetic field which in turn varies with time. This causes the permanent magnet 102 and also the vibration assembly 99 to vibrate or move reciprocally parallel to the axis 98. The vibration is then transmitted to the central portion 18 of the band 12. It should be noted that the amplitude of the vibration increases in proportion to the voltage applied to the coil 110.

A resonance frequency of the vibration assembly 99 is determined by its mass and the elasticity of the elastic plate 96. In this embodiment, the resonance frequency is set to be about 40 Hz from a number of listening tests performed. For this purpose, the elastic plate 96 is made of stainless plate having a thickness of 10 $\mu$m, for example, with its surface coated by a thin silicone rubber (not shown), thereby a suitable Q dump is attained.

The coil 110 in the vibrator 86 is electrically connected with a wire 144 (see FIG. 14). This wire 144 is extended through the passage 112 defined in the connecting portion 22 into the left chamber 80 of the band 12. The wire 138 connected at its one end with the acoustic transducer 44 mounted in the right arm 34 runs through one passage 112 in the right connecting portion 22, the cavity 84 of the vibration output 14, and the other passage 112 in the left intermediate portion 22 of the band 12 into the left chamber 80.

As shown in FIG. 1, the headphone device 10 with the acoustic transducer 44 and the vibrator 86 has an electric cord 126 which is extended out of the left end portion 22 of the band 12 and connected through a suitable plug and jack with a audio device 130. The cord 126 bundles up the above-described electric wires 136, 138, and 144, so that an audio signal is transmitted from the audio device 130 through the wires to the headphone device 10 to produce the corresponding sound and vibrations simultaneously. The cord 126 has a remote controller 128 by which operations (e.g., play and stop operations) of the audio device 130 and operations (e.g., volume control) of the headphone device can be controlled. The audio device 130 may be any type of conventional devices, such as tape device, compact-disc (CD) player or magnetic-disc (MD) player and may be stationary or portable device. Also, the device 130 may be made of single or composite device.

Figure 11:
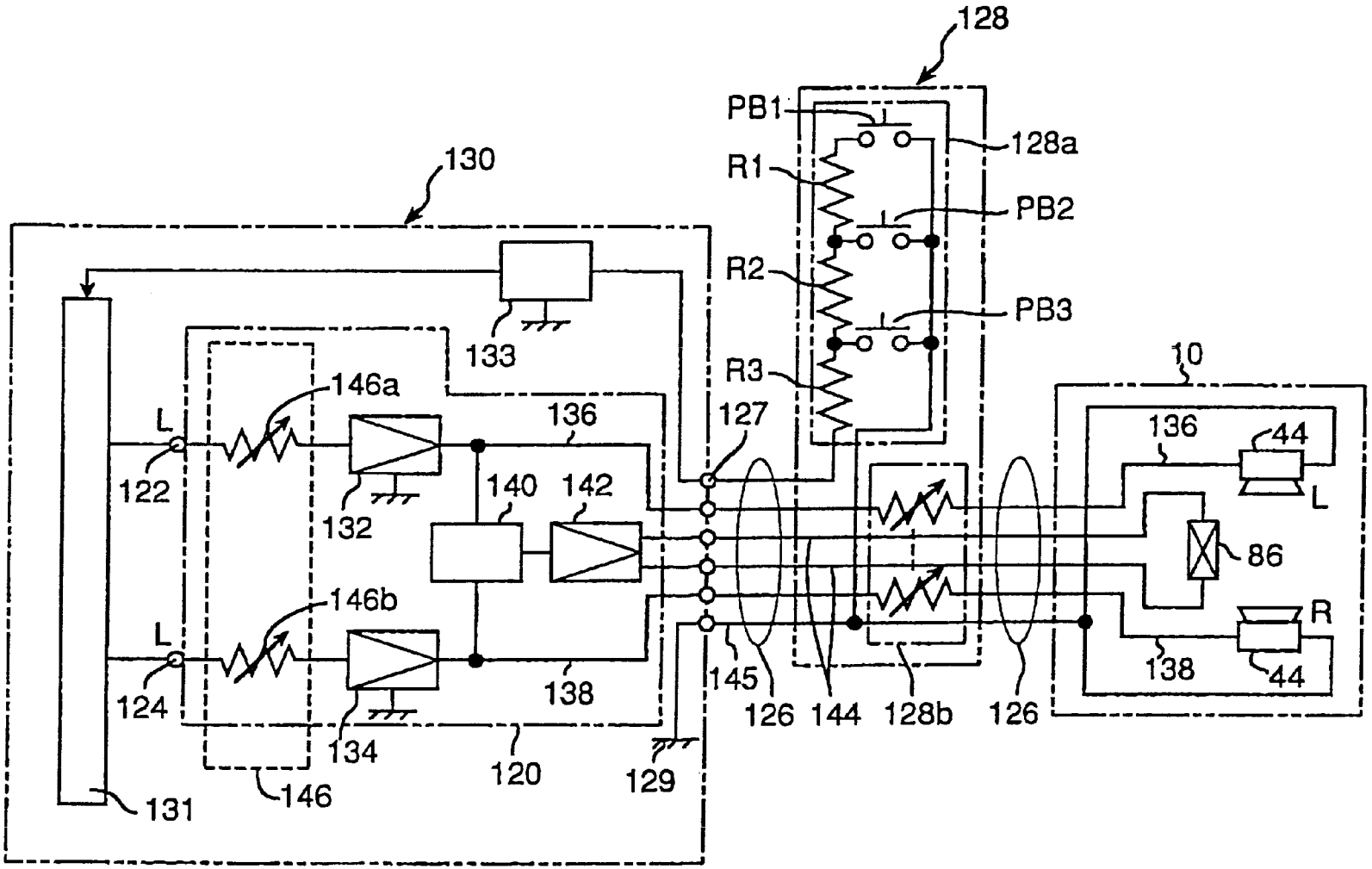
FIG. 11 is a circuit diagram of the headphone apparatus shown in FIG. 1.

Referring to FIG. 11, there is shown a circuit diagram of the headphone device 10, remote controller 128, and audio device 130. In this circuit, the remote controller 128 provided in the cord 126 includes a control 128*a* having a plurality of switches for the operations of the audio device 130 and a volume 128*b* for controlling a output level from the headphone device 10. Therefore, the cord 126, which is connected with the audio device 130 by the plug and jack 127, includes six wires in total, but this is not restrictive to the present invention.

Also, the audio device 130 includes a headphone drive circuit 120, replay device 131 for playing tape or CD, for example, remote control signal input circuit 133. Also, the headphone drive circuit 120 has two input terminals 122 and 124 connected to outputs of left (L) and right (R) channel signals, respectively, of the replay device 131. The terminals 122 and 124 are connected through variable resistances 146*a* and 146*b* in the main volume 146, amplifiers 132 and 134, and wires 136 and 138 with left and right transducers 44, respectively. Further, the volume 128*b* of the remote controller 128 is provided in the wires 136 and 138 for controlling the output to the headphone device 10.

The amplifiers 132 and 134 are connected at its output with a filter circuit 140. The filter circuit 140 filters a signal component having specific a lower band of frequency of the input signal fed from the amplifiers. The filter circuit 140 is in turn connected with a BTL driven amplifier 142 capable of further amplifying the lower band of frequency fed from the filter circuit 140. Further, the amplifier 142 is connected through the wire 144 with the vibrator 86.

In this arrangement, output level of the vibrator 86 is controlled by the main volume 146; though, it may be adjusted by, for example, a volume switch 128*b* provided in the remote controller 128. In this instance, the user can control the level of the vibration readily without reaching the audio device 130.

Further, the sixth wire 145 provided in the cord 126 is used for connecting between the transducers 44 and the ground 129 in the remote controller 128*a*. An input circuit 133 is used to receive a remote control signal from the remote control 128*a* of the controller 128 for controlling the operations of a control circuit (not shown) of the replay device 131. According to the remote control signal from the remote controller, the replay device 131 drives to transmit the audio signal to the input terminals 122 and 124 of the headphone drive circuit 120. The remote control 128*a* includes a plurality of push buttons or switches PB1, PB2, and PB3 and resistances R1, R2, and R3, so that the total circuit resistance varies depending upon which switch is turned on and thereby the operation selected by the pressed button will be performed.

Figure 4:
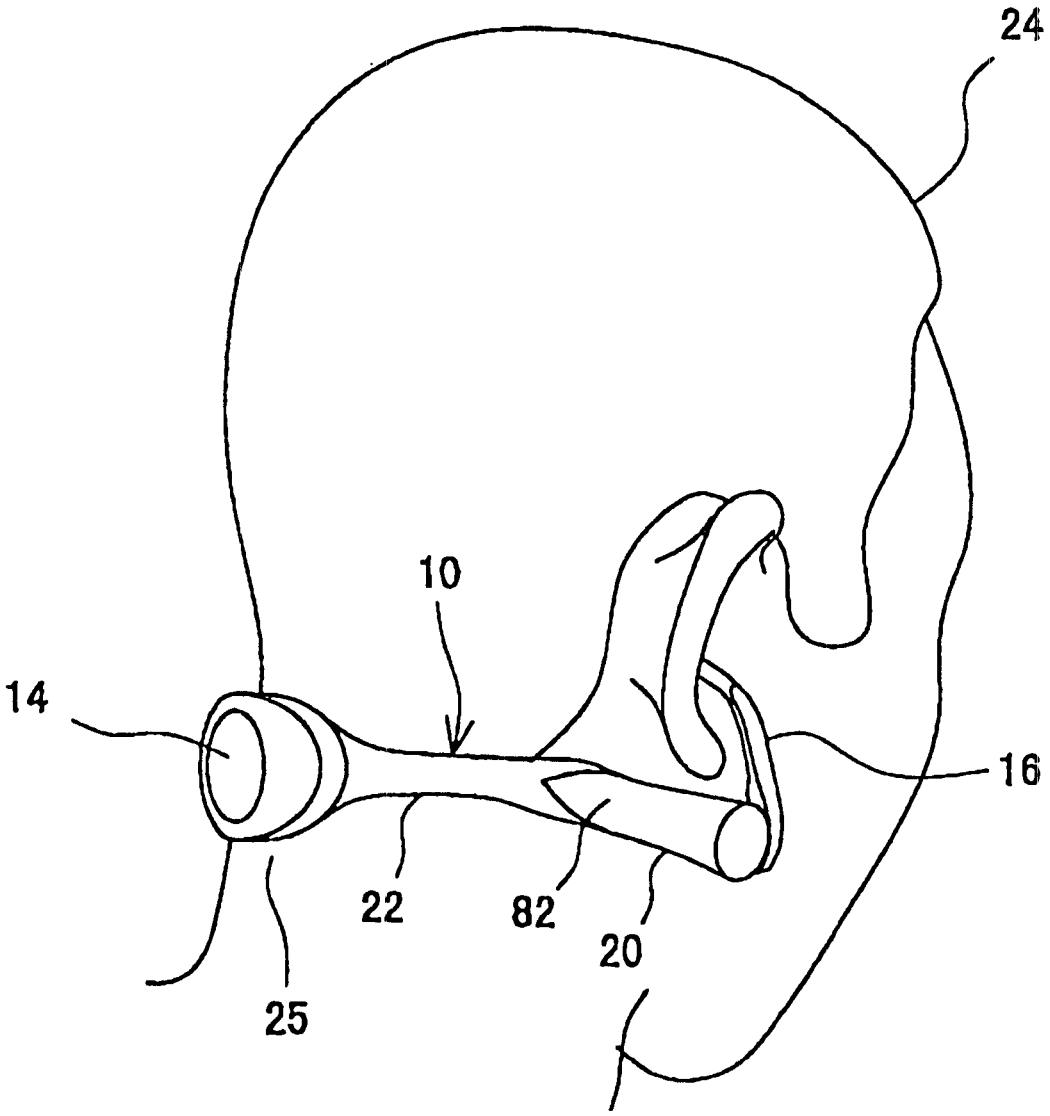
FIG. 4 is a perspective view of the user wearing the headphone apparatus shown in FIG. 1.

When wearing the headphone device 10 so constructed, as best shown in FIGS. 2 and 4 the user 24 positions left and right earphones 42 of the sound generating units 16 adjacent to his or her left and right auricles 30 with the vibration output 14 on his or her back neck. In this state, the arms 34 of the sound generating units 16 are forced toward the respective first positions 62 by the springs 72, so that the vibrator 14 is brought into close contact with the user's back neck.

In the meantime, as already described above, the conventional headphone device has several disadvantages. For example, the left and right vibrators each mounted adjacent to the transducers render the conventional headphone device heavier. Also, the device is supported adjacent to the left and right ears. This requires the headband to be designed so that the sound generating units are placed on the respective ears with a pressure of about 200 g.

Contrary to this, the headphone device 10 of the present invention is supported by three portions, i.e., left and right ears and the back neck. This allows the band 12 to be designed so that it applies only about 50 g on respective ears. Also, the headphone device 10, as it is supported positively by three portions, remains in its regular position with the reduced pressure even when it would suffer from possible shocks at sporting such as jogging. Further, the headphone device 10 extends from one ear to another across the back neck, i.e., nothing exists on the head and therefore it allows the user to put on and off the soft or hard hat without any difficulty.

In operation of the headphone device 10, the replay device 130 produces an audio signal of the music, for example. The reproduced signal is transmitted into the input terminals 122 and 124 of the headphone drive circuit 120. Using the volume 146, the signal can be amplified at the amplifiers 132 and 134. Then, the amplified signal is transmitted through wires 136 and 138 to the left and right transducers 44, respectively. The transducers 44 reproduce a sound corresponding to the amplified signal. Also, the signal is filtered at the filter circuit 140 which passes frequencies up to 200 Hz, preferably up to 150 Hz, and cuts out remaining frequencies. The signal consisting of the low frequencies fed out of the filter circuit 140 is then amplified at the amplifier 142 and further transmitted through the wire 144 to the coil 110 of the vibrator 86. This causes the permanent magnet 102 and then the vibration member 99 to vibrate in accordance with the low frequencies, which vibration is transmitted through the elastic plate 96 to the band 12.

This allows that, the vibration output 14 of the worn headphone device 10 provides the generated vibrations through the band 12 to the user's back neck. A part of the vibrations is also transmitted through the connecting portions 22 and the end portions 20 of the band 12, and then the earphones 42 to the auricles 30 of the user 24. This allows the user 24 to perceive the vibrations at three portions, i.e., mainly at the back of the neck and additionally at the left and right ears.

In addition, although the conventional headphone device provides the user with vibrations at limited portions, i.e., only ears, the headphone device according to the present invention supplies the vibrations to the user at an extended area from one ear to the other around the back of the neck. This means that, although the headphone device 10 of the present invention has only one vibrator and therefore generates less vibration energy than the conventional headphone device with two vibrators, i.e., half of the latter, the vibration energy generated in the headphone device of the present invention is effectively perceived by the user.

Although the headphone device 10 is connected with the audio device 130 through the remote controller 128, the remote controller 128 may be eliminated. In this instance, the headphone device 10 is connected directly to the audio device 130. Also in this instance, the headphone device 10 may be provided with various switches for controlling the volume and so on. For example, referring to FIG. 12, the band 12 has three buttons 150, 152, and 154 and one volume 156. If the replay device is a tape device, the button 150 is used as on/off switch, button 152 as return switch, and button 154 as forward switch. If on the other hand the replay device is a radio, the button 150 is used as AM/FM select switch and buttons 152 and 154 as tuning up and down switches, respectively. Also, the volume 156 may be used for changing a quality of the sound from the transducer 44 and/or level of the vibrations from the vibrator 86.

Also, although the earphone 42 provided at the tip of the arm 34 is a so-called inner-ear type earphone which is sized and shaped to be held on the auricle 30, it may be any type of conventional ones including a so-called outer-ear type earphone to be placed over the ear.

Further, different size of headphones, i.e., large size and small size headphones, may be prepared. For example, for the large size headphone for adult, as shown in FIG. 2 a horizontal distance between the earphone 42 and the transducer 86 may be about 85 mm, and an angle 162 between a line connecting the earphone 42 and the transducer 86 and a vertical line crossing the transducer 86 may be about 75° .

Furthermore, in the previous embodiment, the spring 72 mounted at the connection of the arm 34 and the band 12 is used as the biasing means for forcing the arm 34 to its first position. However, the biasing means is not limited thereto, and may be a helical coil spring which forms the extended portion 38 of the arm or its part. In this instance, the arm 34 may be integrally connected with the band 12.

Thus, an improved headphone device is disclosed. While the embodiments and applications of this invention have been shown and described, and while the best mode contemplated at the present time by the inventors has been described, it should be apparent to those skilled in the art that many more modifications are possible without departing from the inventive concepts therein. In addition, the present invention can be expanded, and is not to be restricted except as defined in the appended claims and reasonable equivalence departing therefrom.

What is claimed is:

1. A headphone apparatus, comprising:

a U-shaped band having opposed opposite ends;

a pair of sound generating units, each of said sound generating units including an acoustic transducer and being supported at a respective one of said opposite ends of said band so as to be placed adjacent to a left ear and a right ear of a user, respectively; and a vibration generating unit including a vibrator, said vibration generating unit being supported at an intermediate portion of said band so as to be placed on a back of a neck of the user; and wherein said pair of sound generating units and said vibration generating unit are arranged such that, in response to an electric audio signal, each of said acoustic transducers generate acoustic sound while said vibrator simultaneously generates vibrations, said band being operable to transmit the vibrations to each of said opposed opposite ends so that the vibrations are transmitted to a user at least at the back of the neck, at the left ear, and at the right ear.

2. The headphone apparatus as recited in claim 1, wherein each of said sound generating units further includes an arm, said arm having a first end connected to a respective one of said opposite ends of said band such that said arm extends radially outwardly from a point on an axis extending across said opposed opposite ends of said band, and said arm having a second end connected to said acoustic transducer.

3. The headphone apparatus as recited in claim 2, wherein each of said arms is rotatably connected to a respective one of said opposed opposite ends so as to be operable to rotate about said axis.

4. The headphone apparatus as recited in claim 2, wherein each of said arms has a spring for biasing said arm about said axis toward said band so that said vibration generating unit is forced against the back of the neck of the user.

5. The headphone apparatus as recited in claim 1, wherein each of said sound generating units further includes an arm, said arm including a housing for receiving said acoustic transducer, said housing being sized and shaped so that it can be placed on an auricle of the user.

6. The headphone apparatus as recited in claim 1, wherein said vibrator is fixed in said band.

7. The headphone apparatus as recited in claim 1, wherein said band has a left elastic portion and a right elastic portion, each of said elastic portions extending between said vibration generating unit and a respective one of said pair of sound generating units.

8. The headphone apparatus as recited in claim 1, wherein said vibration generating unit is operable to receive a specific frequency band of said electric audio signal and to generate vibrations in response to said specific frequency band.

9. The headphone apparatus as recited in claim 8, wherein said specific frequency band includes a lower frequency component of said audio signal.

10. The headphone apparatus as recited in claim 9, further comprising a controller for controlling said specific frequency band to be received by said vibration generating unit.

11. The headphone apparatus as recited in claim 10, wherein said controller is provided in said U-shaped band.

12. The headphone apparatus as recited in claim 1, wherein each of said pair of sound generating units further includes an arm rotatably connected to and extending from a respective one of said pair of opposite ends of said band, said arm having a sprig for biasing said arm toward said band.

13. The headphone apparatus as recited in claim 1, further comprising an audio device electrically connected to said pair of sound generating units and said vibration generating unit, and a controller for operating said audio device, for controlling a volume of sound generated by said pair of sound generating units, and for controlling a frequency band received by said vibration generating unit.

14. The headphone apparatus as recited in claim 13, wherein said audio device includes a filter circuit for filtering said audio signal to generate a filtered audio signal including a lower frequency component of said audio signal, said audio device being connected to said vibration generating unit and said pair of sound generating units so as to deliver said filtered audio signal from said filter circuit to said vibration generating unit while simultaneously delivering an unfiltered audio signal to each of said sound generating units.

15. A method of providing acoustic sound and vibrations simultaneously, comprising:

providing an audio signal;

driving a pair of acoustic transducers in response to said audio signal to generate corresponding acoustic sound, said pair of said acoustic transducers being placed adjacent to respective ears of a user;

driving a vibrator in response to said audio signal to generate corresponding vibrations, said vibrator being placed on a back of a neck of said user between said pair of acoustic transducers; and transmitting the vibrations toward each of said pair of acoustic transducers by a band connecting said vibrator to each of said acoustic transducers.

16. The method of claim 15, wherein said driving of said pair of acoustic transducers and said driving of said vibrator are accomplished simultaneously.

* * * * *

UNITED STATES PATENT AND TRADEMARK OFFICE

CERTIFICATE OF CORRECTION

PATENT NO. : 6,603,863 B1
DATED : August 5, 2003
INVENTOR(S) : Atsushi Nagayoshi It is certified that error appears in the above-identified patent and that said Letters Patent is hereby corrected as shown below:

Title page,
Item [57], ABSTRACT
Line 2, after "user" insert -- , --;
Line 8, after "back" insert -- of the --; and
Line 8, change "Then" to -- As a result --.

Columns 1, line 6 to Column 9, line 55,
Please replace with the following:

Field of the Invention

The present invention relates to a headphone apparatus for use with a stereo audio system. In particular, the present invention relates to a headphone apparatus preferably for use with a portable stereo audio device. Also, the present invention relates to a method for providing sophisticated and dynamic sound through a headphone device.

Background of the Invention

U.S. Patent No. 5,867,582 as well as its original Japanese Patent Application No. 7/288887, both assigned to the applicant, disclose a headphone device having an elongated headband with an approximately semicircular configuration. As is known in the art, the headband is provided at its opposite ends with acoustic transducers, respectively. In addition to this, vibrators are provided adjacent to the transducers at opposite ends of the headband, respectively.

With the headphone device, an audio signal is transmitted to the left and right acoustic transducers. The transducers generate stereo acoustic sound in response to the audio signal. On the other hand, a limited band of frequency, i.e., lower frequencies, of the audio signal is transmitted to the vibrators. In response to the lower frequencies, the vibrators generate vibrations. The generated acoustic sound and vibrations are simultaneously provided to the user who wears the headphone device 10. This allows the user to receive a dynamic stereo sound with vibrations.

However, the headphone device includes left and right vibrators, which disadvantageously causes the headphone device to be heavier.

Also, as is known in the art, in order to support the headphone device in a stable state on the user's head, the headband is configured in the form of reversed "U" so that it can be extended from one ear to another over the head. However, the headband may prevent the user from taking on and off his or her hat. For example, if the user wears the headphone over the hat, in order to take off his or her hat the user must take off the headphone before taking off his or her hat. Alternatively, if the user wears the headphone under the hat, in order to take off the headphone the user must take off It is certified that error appears in the above-identified patent and that said Letters Patent is hereby corrected as shown below:

Columns 1, line 6 to Column 9, line 55 (cont'd), the headphone before taking off his or her hat. Alternatively, if the user wears the headphone under the hat, in order to take off the headphone the user must take off his or her hat before taking off the headphone.

Summary of the Invention

Therefore, an object of the present invention is to provide a headphone apparatus capable of providing dynamic stereo sound concurrent with vibrations.

Another object of the present invention is to provide a headphone apparatus which allows the user to take on and off the headphone without any need for taking off the hat and which allows the user to take on and off the hat without any need for taking off the headphone.

Another object of the present invention is to provide a stylish, well-fashioned headphone apparatus. Another object of the present invention is to provide a method of providing a stereo sound with vibrations, preferably for use in the headphone apparatus.

For those purposes, a headphone apparatus according to the present invention comprises a pair of sound generating units each having acoustic transducers. The sound generating units are designed to be placed adjacent to left and right ears of a user, respectively. The headphone apparatus also has a vibration generating unit having a vibrator. The vibration generating unit is designed to be placed on the back of a user's neck. In operation, in response to an audio signal, the electric transducers generate acoustic sound and the vibrator generates vibrations simultaneously. The acoustic sound is perceived by the left and right ears of the user. On the other hand, the vibrations are perceived at the back of the neck of the user. This allows the user to perceive the acoustic sound simultaneously with the vibrations, which provides the user with a sophisticated and dynamic combination of the sound and vibrations.

In another aspect of the headphone apparatus of the present invention, the headphone apparatus further comprises a U-shaped band having opposed opposite ends. Also, the band supports the sound generating units at the opposite ends, respectively, and the vibration generating unit at its intermediate portion. This allows the user to perceive the vibrations at three portions: the back of the neck and the left and right ears. This means that the user can perceive a dynamic sound effect.

In another aspect of the headphone apparatus of the present invention, each of the sound generating units includes an arm, the arm being connected at one end with one of the opposite ends and extending radially outwardly from an axis extending across the opposed opposite ends of the band. Also, the electric transducer is provided at the other end of the arm. This allows the generated vibrations to be transmitted through the band and arms to the user's ears.

It is certified that error appears in the above-identified patent and that said Letters Patent is hereby corrected as shown below:

Columns 1, line 6 to Column 9, line 55 (cont'd),

In another aspect of the headphone apparatus of the present invention, the arms are rotatably connected with the opposed opposite ends about the axis. This allows the user of the headphone apparatus to adjust a distance between the sound and vibration generating units according to the corresponding size, i.e., the distance from the ear to the back neck, of the user.

In another aspect of the headphone apparatus of the present invention, each of the arms has a spring which biases the arm about the axis toward the band so that the vibration generating unit is forced onto the back of the neck of the user. This allows the vibration generating unit to be positively placed on the back of the neck of the user, causing the user to perceive dynamic stereo sound with vibrations.

In another aspect of the headphone apparatus of the present invention, the arm includes a housing for receiving the acoustic transducer. Also, the housing is sized and shaped so that it can be placed on an auricle of the user. This permits the headphone apparatus to be small sized, light-weight, and easy to carry.

In another aspect of the headphone apparatus of the present invention, the vibrator is fixed in the band. With this arrangement, the vibrations are transmitted through the band to the user's back of the neck and ears.

In another aspect of the headphone apparatus of the present invention, the band has left and right elastic portions, and each of the elastic portions extends from the vibration generating unit and the pair of sound generating units. With this arrangement, the generated vibrations are increased and thereby transmitted the entire length of the band, which causes the user to perceive more dynamic sound with vibrations.

In another aspect of the headphone apparatus of the present invention, the vibration generating unit receives a specific band of frequency in the audio signal and generates vibrations in response to the specific band of frequency. With this arrangement, the vibrations are generated from the specific band of frequency.

In another aspect of the headphone apparatus of the present invention, the specific band of frequency includes a lower frequency component in the audio signal. With this arrangement, in particular when listening to music, the user can perceive the sound and vibrations of low frequencies at the same time. Namely, the user can perceive a realistic performance in which the lower frequencies are strengthened.

In another aspect of the headphone apparatus of the present invention, the headphone apparatus comprises a controller which controls the specific frequencies to be received by the vibration generating unit. This allows the user to control the level of the vibrations depending upon It is certified that error appears in the above-identified patent and that said Letters Patent is hereby corrected as shown below:

Columns 1, line 6 to Column 9, line 55 (cont'd), his or her preference.

In another aspect of the headphone apparatus of the present invention, the controller is provided in the band. With this arrangement, the user can control the level of the vibrations while listening.

Also, a method of providing acoustic sound and vibrations simultaneously, comprises providing an audio signal; driving a pair of acoustic transducers in response to the audio signal to generate a corresponding acoustic sound, the pair of acoustic transducers being placed adjacent to respective ears of a user; and driving a vibrator in response to the audio signal to generate corresponding vibrations, the vibrator being placed on the back of the neck of the user.

Another method of providing acoustic sound and vibrations simultaneously, comprises providing an audio signal; providing acoustic sound in response to the audio signal to left and right ears of a user; and providing vibrations to the back of the neck of the user in response to a lower frequency component of the audio signal.

As can be seen from above, the headphone apparatus and the method thereof can provide acoustic sound and vibrations at the same time. Also, the headphone apparatus and the method thereof allow its user to take on and off the headphone apparatus regardless of whether he or she is wearing a soft or hard hat, and to take on and off the soft or hard hat regardless of whether he or she is wearing a soft or hard hat, and to take on and off the soft or hard hat regardless of whether he or she is wearing the headphone apparatus.

Brief Description of the Drawings

Figure 3:
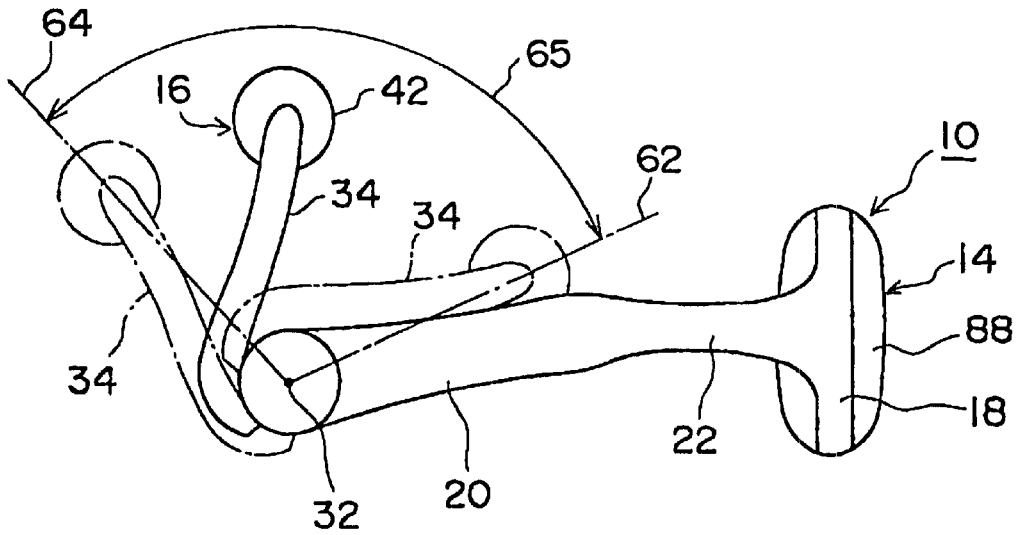
FIG. 3 is a side elevational view of the headphone apparatus according to the present invention, showing a movement of an arm.
Figure 7:
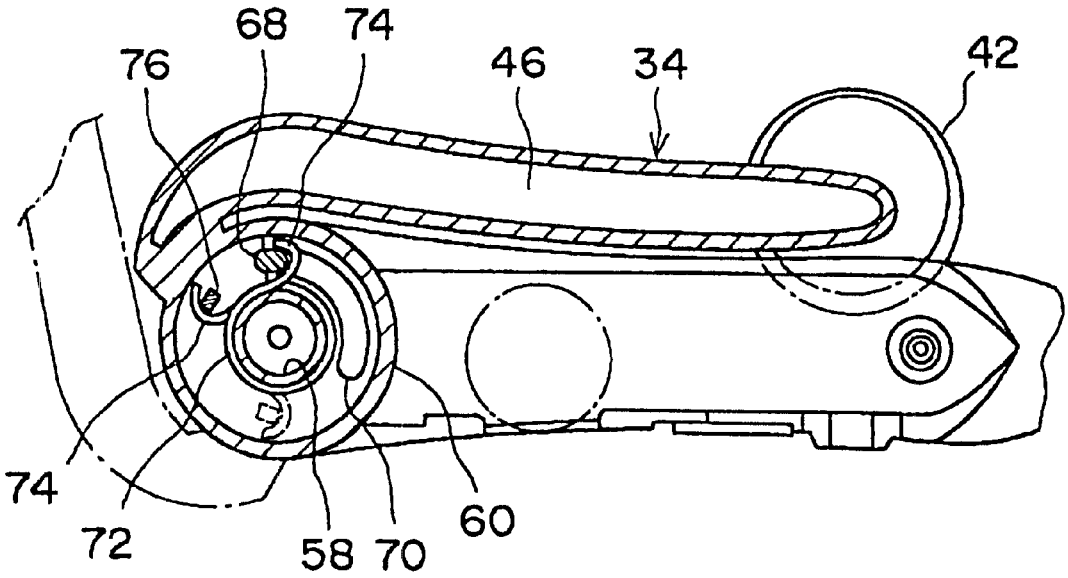
FIG. 7 is a cross-sectional view of the arm of the headphone apparatus in FIG. 1.
Figure 8:
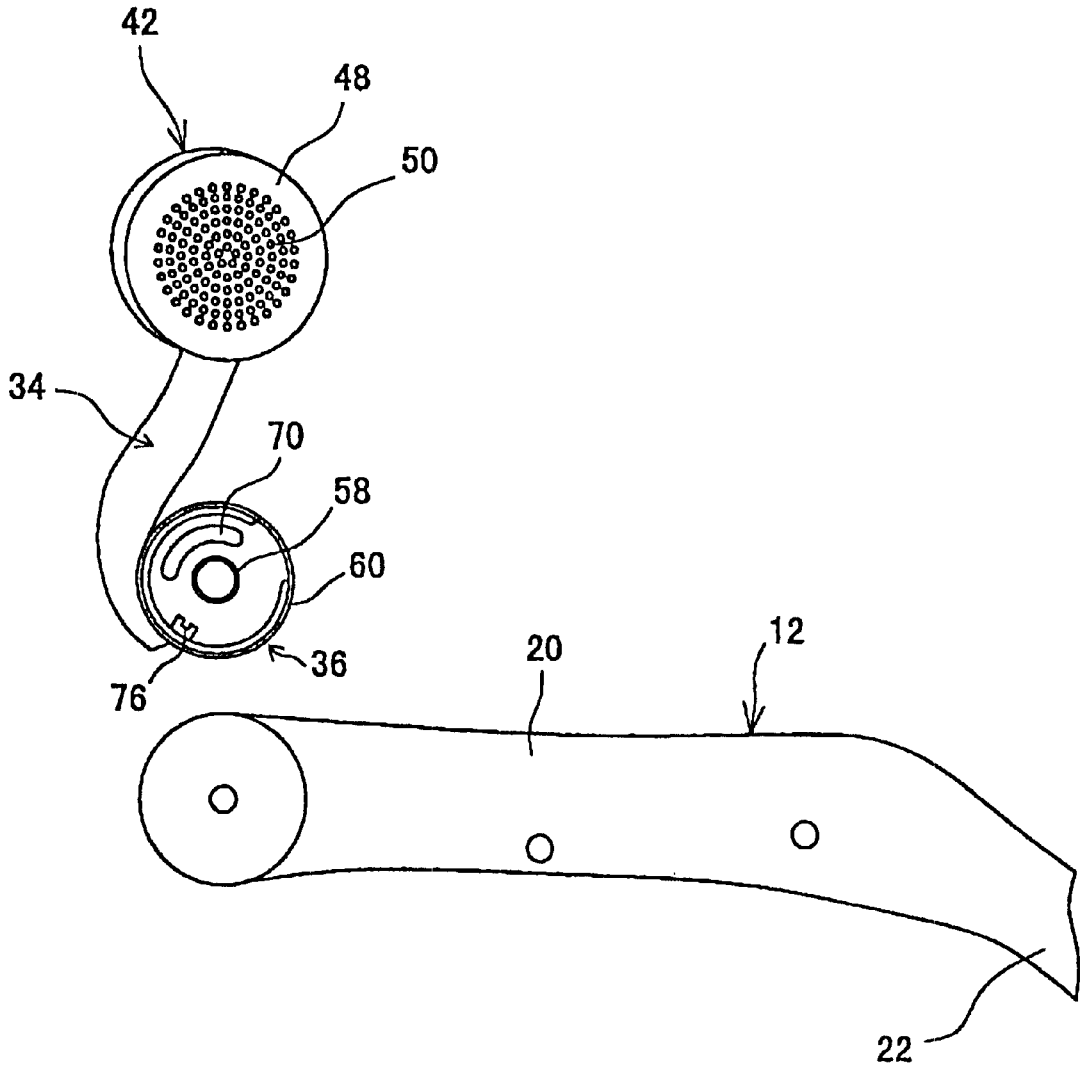
FIG. 8 is a partial perspective view of the exploded headphone apparatus shown in FIG. 1.
Figure 10A:
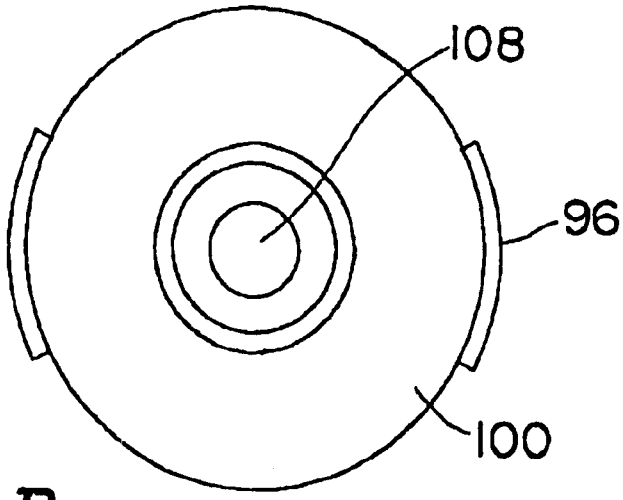
FIGS. 10A to 10C show parts of the vibration generating unit.
Figure 10B:
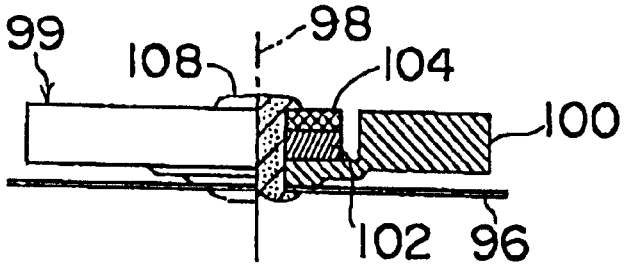
Figure 10C:
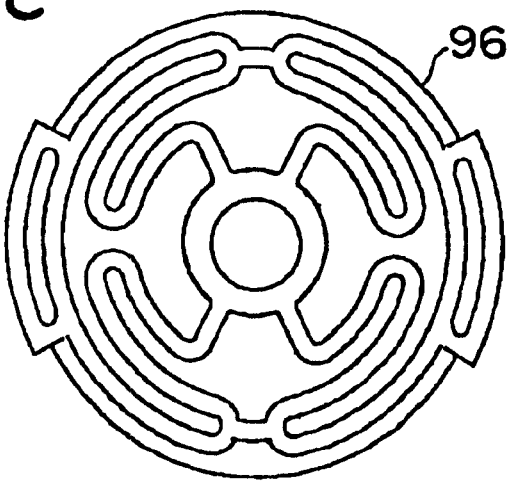

Fig. 1 is a plan view of a headphone apparatus according to the preferred embodiment of the present invention;

Fig. 2 is a perspective view of a user wearing the headphone apparatus shown in Fig. 1;

Fig. 3 is a side elevational view of the headphone apparatus according to the present invention, showing a movement of an arm;

Fig. 4 is a perspective view of the user wearing the headphone apparatus shown in Fig. 1;

Fig. 5 is a perspective view of the exploded headphone apparatus shown in Fig. 1;

Fig. 6 is a partial perspective view of the exploded headphone apparatus shown in Fig. 1;

Fig. 7 is a cross-sectional view of the arm of the headphone apparatus in Fig. 1;

Fig. 8 is a partial perspective view of the exploded headphone apparatus shown in Fig. 1;

Fig. 9 is a cross-sectional view of a vibration generating unit of the headphone apparatus shown in Fig. 1;

Figs. 10A to 10C show parts of the vibration generating unit, and Fig. 10A is a plan view of It is certified that error appears in the above-identified patent and that said Letters Patent is hereby corrected as shown below:

Columns 1, line 6 to Column 9, line 55 (cont'd), a yoke, Fig. 10B is a partial cutout side elevational view of the vibration member, and Fig. 10C is a plan view of a vibration plate;

Fig. 11 is a circuit diagram of the headphone apparatus shown in Fig. 1; and

Figure 12:
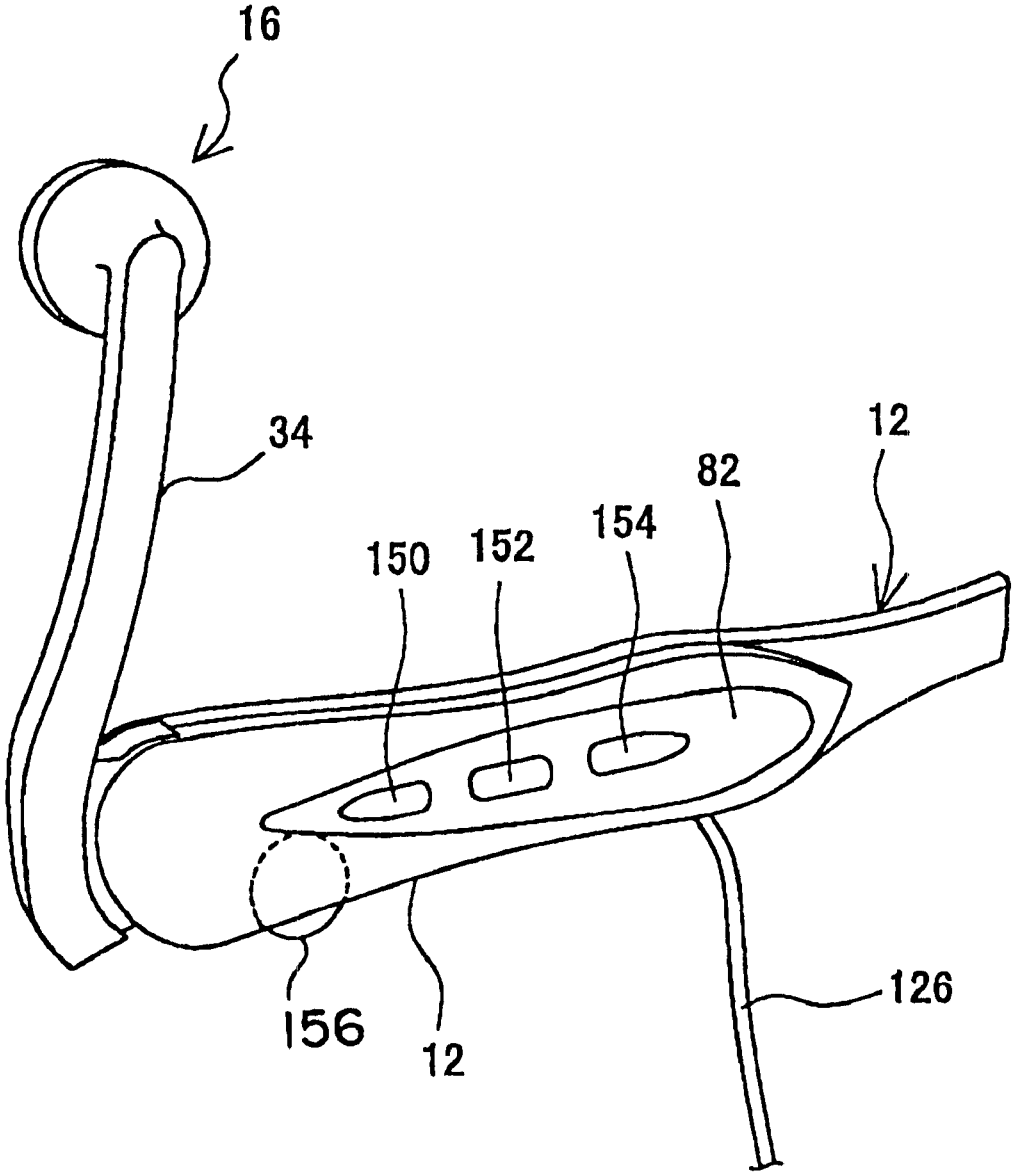
FIG. 12 is a partial perspective view of the headphone apparatus according to another embodiment of the present invention.

Fig. 12 is a partial perspective view of the headphone apparatus according to another embodiment of the present invention.

Detailed Description of the Preferred Embodiments

Referring to Figs. 1 to 5, there is shown a headphone device according to the embodiment of the present invention, generally indicated by reference numeral 10. The headphone device 10 has an approximately U-shaped band, generally indicated by reference numeral 12. Preferably, the band 12 is made of flexible material. The material may be synthetic resin such as polypropylene or metal such as aluminum, stainless, titanate, and combination thereof. For reducing a weight of the headphone device 10, the band 12 should be made of synthetic resin rather than metal. For further reduction of weight, the band 12 according to the embodiment is molded out of polypropylene. However, the band may be assembled with various parts made of resin, metal, or a combination thereof.

As best shown in Fig. 1, the band 12 is provided at its intermediate portion with a vibration generating unit generally indicated by reference numeral 14, and also at its opposite ends with sound generating units each generally indicated by reference numerals 16. Preferably, a central portion 18 of the band 12, where the vibration generation unit 14 is located, and opposite end portions 20 of the band 12, adjacent to the sound generating unit 16, have a greater thickness or rigidity so that they would resist a certain external force. On the other hand, connecting portions 22 extending between the central portion 18 and the opposite end portions 20 may be thinned so that they have a certain elasticity. As a result, when the headphone device 10 is worn by the user, the sound generating units 16 can fit on the desired portions of the ears with a suitable pressure, allowing the headphone device 10 to be supported positively on the user. As shown in Fig. 2, the sound generating unit 16, which is designed in the form of earphone in this embodiment, is suitably fitted on the auricle 30 between the tragus 26 and antitragus 28.

Each of the sound generating units 16 has an arm 34 extending radially and outwardly from an axis 32 (shown as the phantom line in Fig. 1) connecting left and right end portions of the band 12. As best shown in Fig. 6, the arm 34 has four portions; connecting portion 36, extended portion 38, supporting portion 40, and earphone housing 42. The connecting portion 36 is connected to the end portion of the band 12 so that it can rotate about the axis 32. The extended portion 38 is It is certified that error appears in the above-identified patent and that said Letters Patent is hereby corrected as shown below:

Columns 1, line 6 to Column 9, line 55 (cont'd), connected at its first end with the connecting portion 36 and extended outwardly and radially from the axis 32. The supporting portion 40 extends inwardly from the opposite (second) end of the extended portion 38 toward the opposite arm 34. The earphone housing 42 is shaped and sized so that it can be fitted on the auricle 30 between the tragus 26 and antitragus 28 and is mounted at the tip of the supporting portion 40. In this embodiment, the arm 34 is made of several parts, but it may be molded as a single part.

The earphone housing 42 accommodates an acoustic transducer 44. Any type of conventional acoustic transducer may be used as long as it can transduce electric signal into corresponding sound. The transducer 44 is electrically connected with a headphone circuit 120 through wires 136 and 138 (see Fig. 11). To conceal and protect the wires, the arm 34 includes a passage 46 (see Fig. 7) for receiving wires 136 and 138 (also see Fig. 11). Also, as shown in Figs. 5 and 8, the earphone housing 42 includes a plurality of small apertures 50 in its front wall portion 48 which would face to the external auditory meatus of the user 24 when it is fitted to the ear. In this case, the reproduced sound is fed out of the apertures 50. Alternatively, the wall portion 48 may be made of suitable metal mesh.

Referring again to Fig. 6, the arm 34 is connected at its connecting portion 36 with the band 12 so that it can rotate about the axis 32. For this purpose, the end portion of the band 12 for bearing the arm 34 is integrally formed with inner and outer cylindrical receiving portions 52 and 54 in a concentric configuration about the axis 32. The connecting portion 36 of the arm 34, on the other hand, is integrally formed with a doughnut-like disk plate 56, and concentric inner and outer cylindrical portions 58 and 60. The cylindrical portions 58 and 60 project a certain distance from inner and outer peripheries of the disk 56 in the opposite directions and parallel to the axis 32. It should be noted that the outer diameter of the inner cylindrical portion 58 is slightly smaller than the inner diameter of the outer cylindrical receiving portion, and the outer diameter of the outer cylindrical portion 60 is substantially equal to the outer diameter of the outer cylindrical receiving portion 54. Therefore, when assembling, the inner cylindrical portion 58 of the arm 34 can be inserted in the inner cylindrical receiving portion 52 of the band 12 with the end surface of the outer cylindrical portion 60 facing the opposing end surface of the outer cylindrical receiving portion 54. This allows the arm 34 to rotate about the axis 32, relative to the band 12.

Referring again to Fig. 3, a restriction mechanism generally indicated by reference numeral 66 is provided in order to limit a moving range or angle of the arm 34 in between a first position 62 where the arm 34 lies against the band 12 and a second position 64 where the arm 34 is angled away from the band 12. As best shown in Fig. 6, the restriction mechanism 66 includes a pin 68 integrally formed on and projecting from an intermediate portion of a disk between inner and outer It is certified that error appears in the above-identified patent and that said Letters Patent is hereby corrected as shown below:

Columns 1, line 6 to Column 9, line 55 (cont'd), cylindrical receiving portions 52 and 54, toward the connecting portion 36 and parallel to the axis 32. The disk 56 of the connecting portion 36 has an elongated aperture or slot 70 extending peripherally about the axis 32 between the inner and outer cylindrical portions 58 and 60. When assembling the arm 34 with the band 12, the pin 68 is positioned in the slot 70. The opposite ends of the slot 70 correspond to the above-described first and second positions 62 and 64. This means that the arm 34 rotates relative to the band 12 within which the pin 68 can move along the slot 70, i.e., between the first and second positions 62 and 64.

The arm 34 is forced from the second position 64 toward the first position 62 when it is assembled with the band 12. For this purpose, as shown in Fig. 6, a helical spring 72 is mounted around the inner cylindrical portion 58 adjacent to the outside surface of the disk 56. The helical spring 72 is formed at its opposite ends with curved portions or hooks 74. One hook 74 is engaged with the tip portion of the pin 68 projecting from the slot 70, and the other hook 74 is engaged with a portion 76 projecting from the inner surface of the outer cylindrical portion 60, causing the arm 34 to be forced from the second position 64 toward the first position 62.

Referring again to Fig. 6, the outer cylindrical portion 60 of the connecting portion 36 is formed with a cutout 78 in its end portion facing the cylindrical receiving portion 54. The cutout 78 is used for guiding the wires 136 and 138 (see Fig. 11), connected with the transducer 44 and extending out of the proximal end of the extended portion 38, into a chamber 80 defined on the outside of the end portion of the band 12. As can be seen from the drawing, the cutout 78 extends along the periphery of the outer cylindrical portion 60 so that, when the arm 34 rotates relative to the band 12 between the first and second positions 62 and 64, no damaging tension or shearing stress would act on the wire 136 or 138. For safe, the chamber 80 is of course closed with a suitable cover 82 (see Fig. 5).

Referring to Fig. 5, the vibration generating unit 14 has an ellipsoidal portion 83 which is integrated in the central portion of the band 12 by extending the central portion widthwise. The ellipsoidal portion 83 is recessed inwardly to define a cavity 84 in which the vibrator 86 is fixedly received. The cavity 84 is closed at its opening so that the vibrator 86 is not viewable.

As best shown in Fig. 9, the vibrator 86 includes a base plate 90 and cylindrical cover 92 arranged so that they define a chamber having a certain volume. Also, the vibrator 86 is secured in the cavity 84 using a plurality of suitable screws 94. In the chamber between the base plate 90 and cylindrical cover 92, a thinned circular plate 96 made of metal is supported. In this embodiment, the plate 96 is held at its peripheral portions by the base plate 90 and the cylindrical cover 92. Also, as best shown in Fig. 10C, the plate 96 has several elongated cutouts so that it has a suitable elasticity.

Also, a yoke 100 is coaxially provided on the elastic plate 96. The yoke 100 has a It is certified that error appears in the above-identified patent and that said Letters Patent is hereby corrected as shown below:

Columns 1, line 6 to Column 9, line 55 (cont'd), cylindrical recess at its center in which cylindrical permanent magnet 102 and metal plate 104 are received. Preferably, the yoke 100, permanent magnet -102, and metal 104 are arranged in concentric fashion about a central axis 98 of the elastic plate 96 and secured on the elastic plate 96 by a fixing member 108 extending along the axis 98, thereby constituting a vibration assembly 99.

Further, a helical coil 110 is provided in the chamber. The coil 110 is fixed at its first end on the inner surface of the top wall of the cover 92 and extends into a cylindrical space defined between the permanent magnet 104 and a portion of the yoke 100 spaced away from the magnet. Therefore, when the helical coil 110 is biased with an electrical signal or variable voltage which varies with time, e.g., audio signal, it generates a magnetic field which in turn varies with time. This causes the permanent magnet 102 and also the vibration assembly 99 to vibrate or move reciprocally parallel to the axis 98. The vibration is then transmitted to the central portion 18 of the band 12. It should be noted that the amplitude of the vibration increases in proportion to the voltage applied to the coil 110.

A resonance frequency of the vibration assembly 99 is determined by its mass and the elasticity of the elastic plate 96. In this embodiment, the resonance frequency is set to be about 40Hz from a number of listening tests performed. For this purpose, the elastic plate 96 is made of stainless steel having a thickness of 10μm, for example, with its surface coated by a thin silicone

--- rubber (not shown), thereby a suitable Q dump is attained.

The coil 110 in the vibrator 86 is electrically connected with a wire 144 (see Fig. 14). This wire 144 extends through the passage 112 defined in the connecting portion 22 into the left chamber 80 of the band 12. The wire 138 connected at its one end with the acoustic transducer 44 mounted in the right arm 34 runs through one passage 112 in the right connecting portion 22, the cavity 84 of the vibration output 14, and the other passage 112 in the left intermediate portion 22 of the band 12 into the left chamber 80.

As shown in Fig. 1, the headphone device 10 with the acoustic transducer 44 and the vibrator 86 has an electric cord 126 which extends out of the left end portion 22 of the band 12 and connects through a suitable plug and jack with an audio device 130. The cord 126 bundles up the above-described electric wires 136, 138, and 144, so that an audio signal is transmitted from the audio device 130 through the wires to the headphone device 10 to produce the corresponding sound and vibrations simultaneously. The cord 126 has a remote controller 128 by which operations (e.g., play and stop operations) of the audio device 130 and operations (e.g., volume control) of the headphone device can be controlled. The audio device 130 may be any type of conventional device, such as a tape device, compact-disc (CD) player or magnetic-disc (MD) player, and may be a stationary or portable device. Also, the device 130 may be a single or composite device.

---

It is certified that error appears in the above-identified patent and that said Letters Patent is hereby corrected as shown below:

Columns 1, line 6 to Column 9, line 55 (cont'd),

Referring to Fig. 11, there is shown a circuit diagram of the headphone device 10, remote controller 128, and audio device 130. In this circuit, the remote controller 128 provided in the cord 126 includes an operation control 128a having a plurality of switches for the operations of the audio device 130 and a volume control 128b for controlling an output level from the headphone device 10. Therefore, the cord 126, which is connected with the audio device 130 by the plug and jack 127, includes six wires in total, but this is not restrictive in the present invention.

Also, the audio device 130 includes a headphone drive circuit 120, replay device 131 for playing tape or CD, for example, and a remote control signal input circuit 133. Also, the headphone drive circuit 120 has two input terminals 122 and 124 connected to outputs of left (L) and right (R) channel signals, respectively, of the replay device 131. The terminals 122 and 124 are connected through variable resistances 146a and 146b in the main volume controller 146, amplifiers 132 and 134, and wires 136 and 138 with left and right transducers 44, respectively. Further, the volume control 128b of the remote controller 128 is provided in the wires 136 and 138 for controlling the output to the headphone device 10.

The amplifiers 132 and 134 are each connected at its output with a filter circuit 140. The filter circuit 140 filters a signal component having, specifically, a lower band of frequency of the input signal fed from the amplifiers. The filter circuit 140 is in turn connected with a BTL driven amplifier 142 capable of further amplifying the lower band of frequency fed from the filter circuit 140. Further, the amplifier 142 is connected through the wire 144 with the vibrator 86.

In this arrangement, the output level of the vibrator 86 is controlled by the main volume control 146. However, the vibration frequency may also be adjusted by, for example, a volume switch 128b provided in the remote controller 128. In this instance, the user can control the level of the vibration readily without reaching the audio device 130.

Further, the sixth wire 145 provided in the cord 126 is used for connecting the transducers 44 and the ground 129 in the remote controller 128a. An input circuit 133 is used to receive a remote control signal from the remote operation control 128a of the controller 128 for controlling the operations of a control circuit (not shown) of the replay device 131. According to the remote control signal from the remote controller, the replay device 131 drives to transmit the audio signal to the input terminals 122 and 124 of the headphone drive circuit 120. The remote operation control 128a includes a plurality of push buttons or switches PB1, PB2, and PB3 and resistances R1, R2, and R3, so that the total circuit resistance varies depending upon which switch is turned on and thereby the operation selected by the pressed button will be performed.

When wearing the headphone device 10 so constructed, as best shown in Figs. 2 and 4 the user 24 positions left and right earphones 42 of the sound generating units 16 adjacent to his or her It is certified that error appears in the above-identified patent and that said Letters Patent is hereby corrected as shown below:

Columns 1, line 6 to Column 9, line 55 (cont'd), left and right auricles 30 with the vibration output unit 14 on his or her back of the neck. In this state, the arms 34 of the sound generating units 16 are forced toward the respective first positions 62 by the springs 72, so that the vibrator 14 is brought into close contact with the user's back of the neck.

In the meantime, as already described above, the conventional headphone device has several disadvantages. For example, the left and right vibrators each mounted adjacent to the transducers render the conventional headphone device heavier. Also, the device is supported adjacent to the left and right ears. This requires the headband to be designed so that the sound generating units are placed on the respective ears with a pressure of about 200g.

Contrary to this, the headphone device 10 of the present invention is supported by three portions, i.e., left and right ears and the back of the neck. This allows the band 12 to be designed so that it applies only about 50g on respective ears. Also, the headphone device 10, as it is supported positively by three portions, remains in its regular position with the reduced pressure even when it is affected by possible shocks during activities such as jogging. Further, the headphone device 10 extends from one ear to another across the back of the neck, i.e., nothing exists on the head, and therefore it allows the user to put on and remove the soft or hard hat without any difficulty.

In operation of the headphone device 10, the replay device 130 produces an audio signal of the music, for example. The reproduced signal is transmitted into the input terminals 122 and 124 of the headphone drive circuit 120. Using the volume control 146, the signal can be amplified at the amplifiers 132 and 134. Then, the amplified signal is transmitted through wires 136 and 138 to the left and right transducers 44, respectively. The transducers 44 reproduce a sound corresponding to the amplified signal. Also, the signal is filtered at the filter circuit 140 which passes frequencies up to 200Hz, preferably up to 150Hz, and cuts out remaining frequencies. The signal consisting of the low frequencies fed out of the filter circuit 140 is then amplified at the amplifier 142 and further transmitted through the wire 144 to the coil 110 of the vibrator 86. This causes the permanent magnet 102 and then the vibration member 99 to vibrate in accordance with the low frequencies, which vibration is transmitted through the elastic plate 96 to the band 12.

The vibration output 14 of the worn headphone device 10 applies the generated vibrations through the band 12 to the user's back of the neck. A part of the vibrations is also transmitted through the connecting portions 22 and the end portions 20 of the band 12, and then the earphones 42 to the auricles 30 of the user 24. This allows the user 24 to perceive the vibrations at three portions, i.e., mainly at the back of the neck and additionally at the left and right ears.

In addition, although the conventional headphone device provides the user with vibrations at limited portions, i.e., only ears, the headphone device according to the present invention supplies It is certified that error appears in the above-identified patent and that said Letters Patent is hereby corrected as shown below:

Columns 1, line 6 to Column 9, line 55 (cont'd), the vibrations to the user at an extended area from one ear to the other around the back of the neck. This means that, although the headphone device 10 of the present invention has only one vibrator and therefore generates less vibration energy than the conventional headphone device with two vibrators, i.e., half of the latter, the vibration energy generated in the headphone device of the present invention is effectively perceived by the user.

Although the headphone device 10 is connected to the audio device 130 through the remote controller 128, the remote controller 128 may be eliminated. In this instance, the headphone device 10 is connected directly to the audio device 130. Also in this instances, the headphone device 10 may be provided with various switches for controlling the volume and so on. In other words, the controller is located in the band. For example, referring to Fig. 12, the band 12 has three buttons 150, 152, and 154 and one volume 156. If the replay device is a tape device, the button 150 is used as an on/off switch, button 152 as a return switch, and button 154 as a forward switch. If, on the other hand, the replay device is a radio, the button 150 is used as an AM/FM select switch and buttons 152 and 154 as tuning up and down switches, respectively. Also, the volume control 156 may be used for changing a quality of the sound from the transducer 44 and/or level of the vibrations from the vibrator 86.

Also, although the earphone 42 provided at the tip of the arm 34 is a so-called inner-ear type earphone which is sized and shaped to be held on the auricle 30, it may be any type of conventional earphone, including a so-called outer-ear type earphone to be placed over the ear.

Further, different size of headphones, i.e., large size and small size headphones, may be prepared. For example, for the large size headphone for adult, as shown in Fig. 2, a horizontal distance between the earphone 42 and the transducer 86 may be about 85mm, and an angle 162 between a line connecting the earphone 42 and the transducer 86 and a vertical line crossing the transducer 86 may be about 75°.

Furthermore, in the previous embodiment, the spring 72 mounted at the connection of the arm 34 and the band 12 is used as the biasing means for forcing the arm 34 to its first position. However, the biasing means is not limited thereto, and may be a helical coil spring which forms the extended portion 38 of the arm or its part. In this instance, the arm 34 may be integrally connected with the band 12.

Thus, an improved headphone device may be provided. While the embodiments and applications of this invention have been shown and described, and while the best mode contemplated at the present time by the inventors has been described, it should be apparent to those skilled in the art that many more modifications are possible without departing from the inventive concepts therein. In addition, the present invention can be expanded, and is not to be restricted except as defined in the appended claims and reasonalble equvalence departing thereform.

UNITED STATES PATENT AND TRADEMARK OFFICE

CERTIFICATE OF CORRECTION

PATENT NO. : 6,603,863 B1
DATED : August 5, 2003
INVENTOR(S) : Atsushi Nagayoshi It is certified that error appears in the above-identified patent and that said Letters Patent is hereby corrected as shown below:

Column 10,
Line 54, change “sprig” to -- spring --.

Signed and Sealed this

Twenty-fourth Day of August, 2004

JON W. DUDAS
*Director of the United States Patent and Trademark Office*